United States Patent [19]

Miller et al.

[11] Patent Number: 4,752,003

[45] Date of Patent: Jun. 21, 1988

[54] BOOK AND MOUNTED CONTAINER

[76] Inventors: Ruth E. Miller; Jack V. Miller, both of 700 N. Auburn Ave., Sierra Madre, both of Calif. 91024

[21] Appl. No.: 81,640

[22] Filed: Apr. 27, 1987

[51] Int. Cl.[4] ..... B65D 73/00

[52] U.S. Cl. ..... 206/232; 206/469; 206/470

[58] Field of Search ..... 206/232, 461, 467, 469, 206/470

[56] References Cited

U.S. PATENT DOCUMENTS

| | | | |
|---|---|---|---|
| 1,890,988 | 12/1932 | Harden | 206/232 |
| 2,799,391 | 7/1957 | Eisner | 206/232 |
| 3,372,802 | 3/1968 | Repko | 206/469 |
| 3,641,684 | 2/1972 | Paige | 206/232 X |
| 3,939,979 | 2/1976 | Neumayer | 206/470 X |
| 4,566,590 | 1/1986 | Manning et al. | 206/232 |

FOREIGN PATENT DOCUMENTS

| | | | |
|---|---|---|---|
| 477568 | 6/1929 | Fed. Rep. of Germany | 206/232 |

*Primary Examiner*—William Price

[57] ABSTRACT

A book and container includes a book and a formed thin-walled hollow shell with one open side having a flange closed by one of the book covers to form a closed container. The container has bottom side normal to and flush with the bottom edge of the book, and has a top side joined to the rest of the shell with an elongated upstanding rib in the cross-sectional shape of a narrow inverted U, wherein a first leg of the U is contiguous with the top side of the container, and a second leg of the U is contiguous with the rest of the shell; whereby cutting the base of the U away from the legs of the U will separate the top side of the shell from the rest of the shell to permit the container to be opened.

5 Claims, 3 Drawing Sheets

BOOK AND MOUNTED CONTAINER

BACKGROUND OF THE INVENTION

This invention relates to the field of product packaging, and particularly to the packaging techniques generally known as "blister packs". Blister packs normally comprise a "blister" made of a thin, transparent plastic thermoformed shell having a planar flanged perimeter that is sealed to a flat sheet of cardboard.

The principal advantages of blister packs are the excellent visibility of the product contained in the pack, great resistance to opening the package by a shopper in a store, and minimal cost of packaging labor and materials. Blister packs may be opened after purchase by one of two methods; either slicing along the length of the blister with a sharp knife, or tearing the cardboard behind the blister. Either of these methods of opening generally destroys the package, so the product, once removed, cannot be stored in the container in which it was purchased.

In order to provide storage for a product after the package has been opened, some manufacturers resort to two-sided formed plastic containers known as "clam shell" packages, and various other more expensive display packages having multiple plastic parts to function as transparent display boxes.

Transparent display boxes are sometimes used for packaging books along with accompanying products, such as tools, materials, audio tapes and video tapes. Such packages usually include the book and product in a thermoformed nesting carrier that is placed into a shallow box bottom, and then closed with a clear plastic box cover or shrink plastic sheet.

One severe problem with such packages is that they are often damaged by shoppers who want to examine the contents of the book before buying; so they tear open the cover and make the package unsaleable. Therefore a store manager often will place such packages high above the customers' reach to avoid damaged merchandise. This limits sales, and also requires the expense of a store clerk to get the package off the shelf for the customer.

Another problem is that such packages do not fit on a book shelf with the spine of the book facing the shopper. Instead they must be displayed with the flat transparent surface facing the aisle, taking up the shelf space of a dozen or more books that might otherwise be sold. Therefore it is usually the practice of store managers to place such packages either on a bottom shelf or in a low traffic area.

It is the purpose of this invention to provide a package for a product accompanying a book, which has the blister pack advantages of product visibility, security and low cost, but leaves the book open for inspection by a shopper without damage to the package. It is a further purpose of this invention to provide a package for a product accompanying a book in which the book and package may be displayed normally and compatibly with other books on a book store shelf, and preserving the sales potential of the high traffic locations.

It is a further purpose of this invention to provide a blister pack for a product accompanying a book, wherein the book is not enclosed, permitting examination by a shopper, but in which the blister is very resistant to opening by a shopper in a store; however, the blister is easily opened by the purchaser at home, and is reclosable for storage of the product after the initial opening.

SUMMARY OF THE INVENTION

The achievement of the foregoing purposes of the invention are embodied in the present invention by providing a book and container including a book having a top edge, a bottom edge, a front cover, a back cover, a spine defining a front edge, with the pages bound together at the spine and openable at a back edge opposite the spine.

A formed thin-walled hollow container shell is made of a readily formable thermoplastic material, such as transparent polyvinyl chloride having a thickness from 0.005 to 0.020 inches. The hollow container is generally pan-shaped, with one open side having a generally planar perimeter flange. The flange is substantially attached to and closed by one of the book covers, usually the back cover of the book, with a bonding method typical of the thermal or sonic bonding processes common in ordinary blister packaging.

A book and container shell are bonded together with a product in place within the shell, with the perimeter sealed against intrusion by a shopper. The formed container shell has a generally planar panel parallel to the plane of the bonding flange, a first side adjacent to the spine of the book, a second side adjacent to the back edge of the book, a top side at the top edge of the book and a bottom side at the bottom edge of the book. At least a portion of the bottom side is generally normal to and flush with the bottom edge of the book, whereby the bottom edge of the container shell and the bottom edge of the book are in a common plane so the book and container stand up in a stable condition on a shelf, with the spine vertical to display the title indicia.

The container shell has its top surface joined to the rest of the shell by an upstanding rib in the cross-sectional shape of a narrow inverted U, wherein a first leg of the U is contiguous with the top side of the container, a second leg of the U is contiguous with the planar surface, the first side, and the second side, respectively, and the base of the inverted U is upstanding; whereby cutting the base of the U away from the legs separates the top side from the planar panel, the first side and the second side, respectively, and permits the container to be opened. Cutting the base of the rib off with an ordinary pair of scissors provides the customer easy access to the product by then lifting up the cut edge of top of the shell. Opening the shell may be further facilitated by perforating the thin shell material at the juncture of the top and the rest of the container shell, whereby the top may be torn open along the perforation.

DETAILED DESCRIPTION OF THE DRAWINGS

Figure 1:
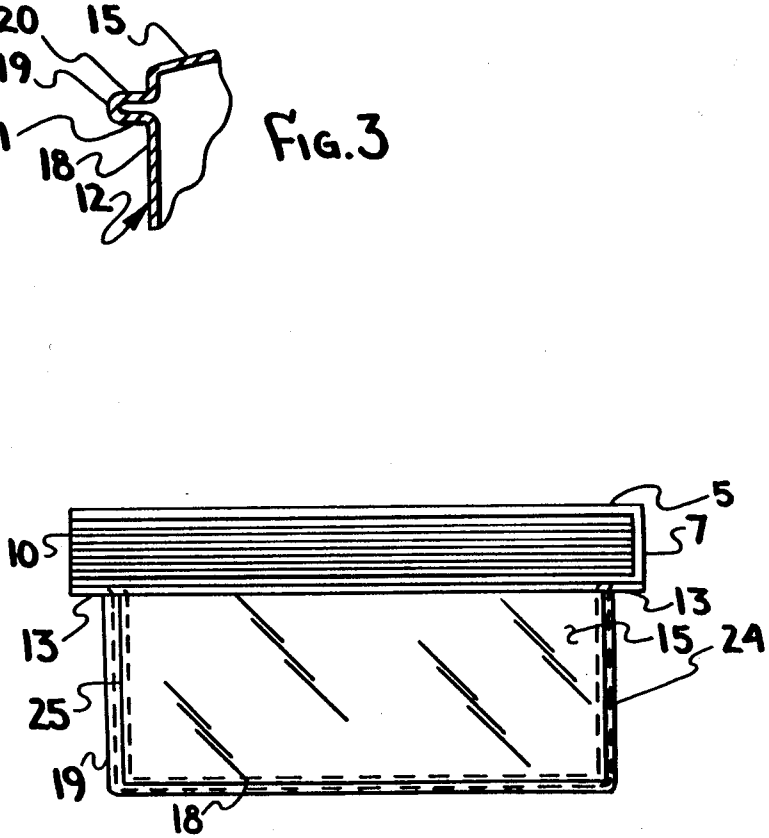
FIG. 1 shows a perspective view of a book and container according to the present invention.

In FIG. 1 a book and container assembly 1 is shown having a book 2 having a top edge 3, a bottom edge 4, a front cover 5, a back cover 6, a spine 7 defining a front edge 8, and a plurality of pages 9 joined together at the spine 7 and openable at the back edge 10. Book 2 is joined with an adhesive means to a thin shell 12, which is provided with a perimeter flange 13 bounding an open side of the shell which is closed by the back cover 6 of book 2. The shell 12 is typically made of a thin thermoplastic material, such as transparent polyvinyl chloride having a thickness of 0.005 to 0.020 inches. Shell 12 may be optionally joined to and closed by the front cover 5 instead of the back cover 6, depending on the specific packaging requirements of the contents to be packaged within the shell at the time of bonding to the book.

Figure 2:
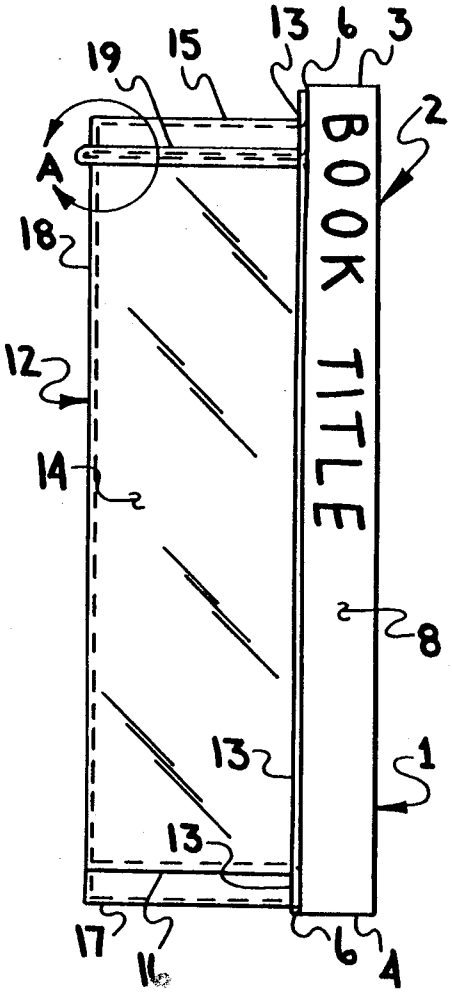
FIG. 2 is a side elevation view of the spine side of the book and container.

In FIG. 2 the book and container assembly 1 is shown with front edge 8 of book 2 having top edge 3 and bottom edge 4. Shell 12 is shown having its flange 13 joined to back cover 6 of book 2, so that front side 14 of shell 12 is adjacent to the front edge 8 of book 2, with a top side 15 of shell 12 adjacent to the top edge 3 of book 2; and a bottom side 16 of shell 12 adjacent to the bottom edge 4 of book 2. Portions 17 of bottom side 16 are normal to the plane of back cover 6, and are flush with the bottom edge 4 of book 2; whereby the container and book assembly 1 is supported by both the book 2 and shell 12 in the normal display orientation on a flat surface, such as a book shelf, with the spine vertical. A generally planar panel 18 is a plane parallel to flange 13, extends from the top side 15 to bottom side 16, and is interrupted by an upstanding rib 19.

Figure 3:
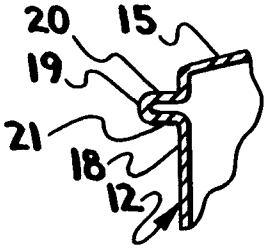
FIG. 3 is an enlarged cross-sectional view of the portion of view A of FIG. 2.

FIG. 3 shows a cross-sectional view of rib 19, which is in the shape of a narrow U with one leg 20 joining the edge of top side 15 and a second leg 21 joining planar panel 18. One preferred embodiment includes a perforation at or near the intersection of leg 21 and panel 18, whereby rib 19 may be torn loose from panel 18.

Figure 4:
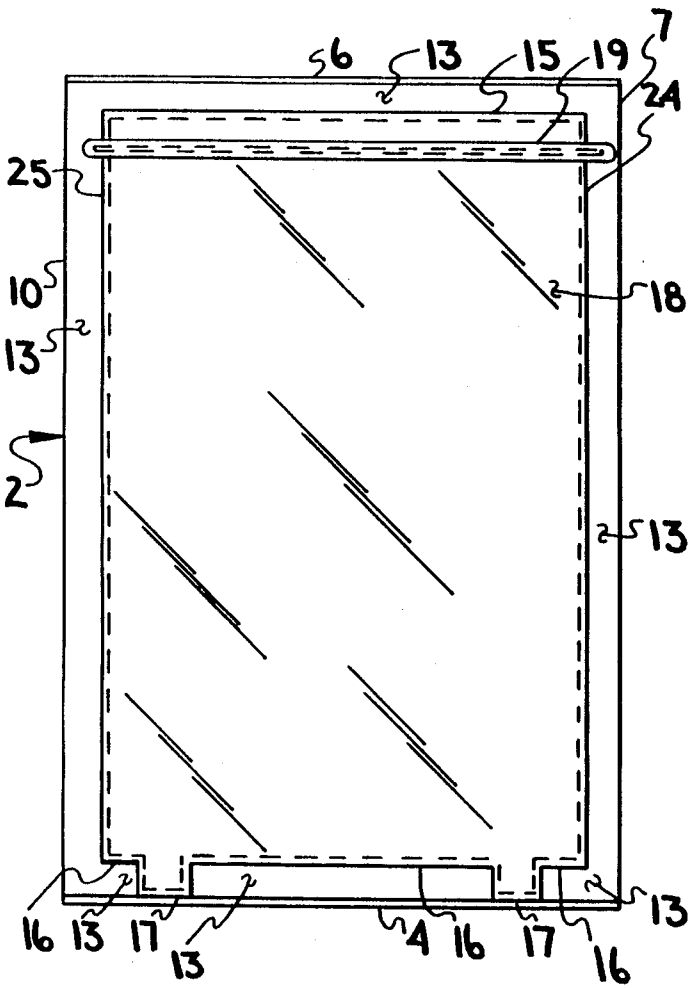
FIG. 4 is a side elevation view of the back cover of the book, showing the container shell in place.

FIG. 4 shows rib 19 extending from flange 13 adjacent to spine 7, across front side 24, panel 18 and the back side 25 of shell 2, to terminate at flange 13 adjacent to the back edge 10. Bottom side 16 terminates in flange 13, and one or more portions 17 of bottom side 16 are extended to the plane of the bottom edge 4 of book 2.

Figure 5:
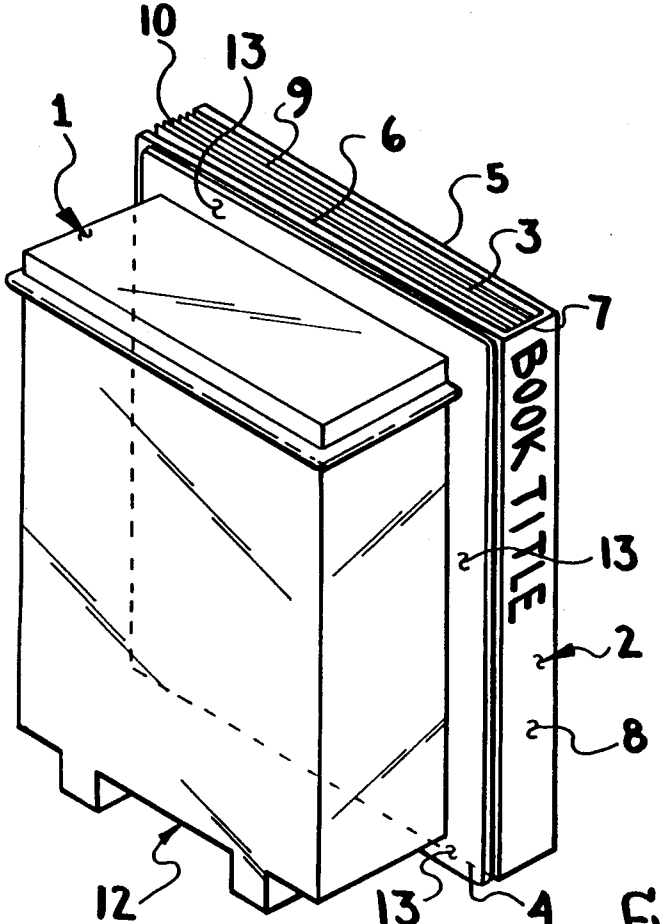
FIG. 5 is a top plan view of the book and container.

FIG. 5 also shows rib 19 extending from flange 13 adjacent to spine 7, across front side 24, panel 18 and the back side 25 of shell 2, to terminate at flange 13 adjacent to back edge 10.

Figure 6:
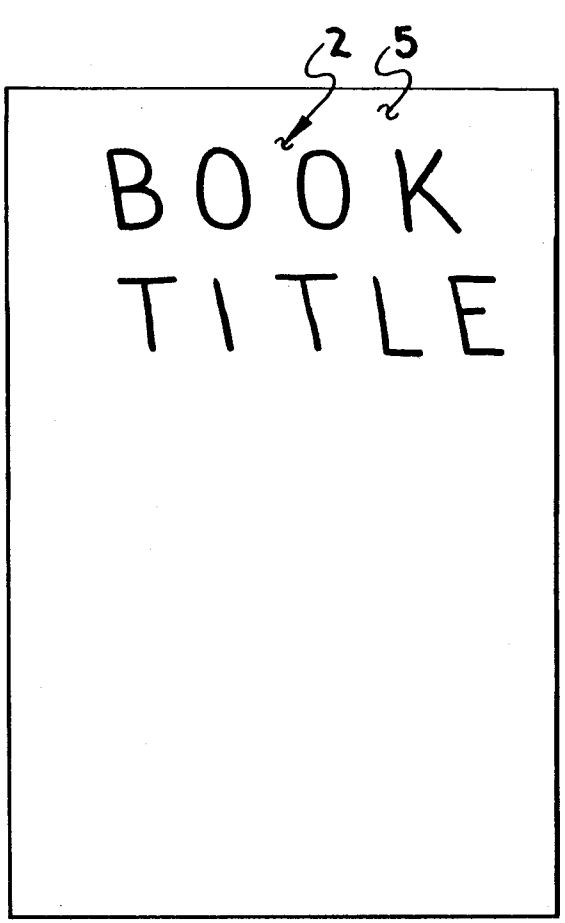
FIG. 6 is a side elevation view of the front cover of the book.

FIG. 6 shows the front cover 5 of book 2, which is not covered by any portion of shell 12.

Figure 7:
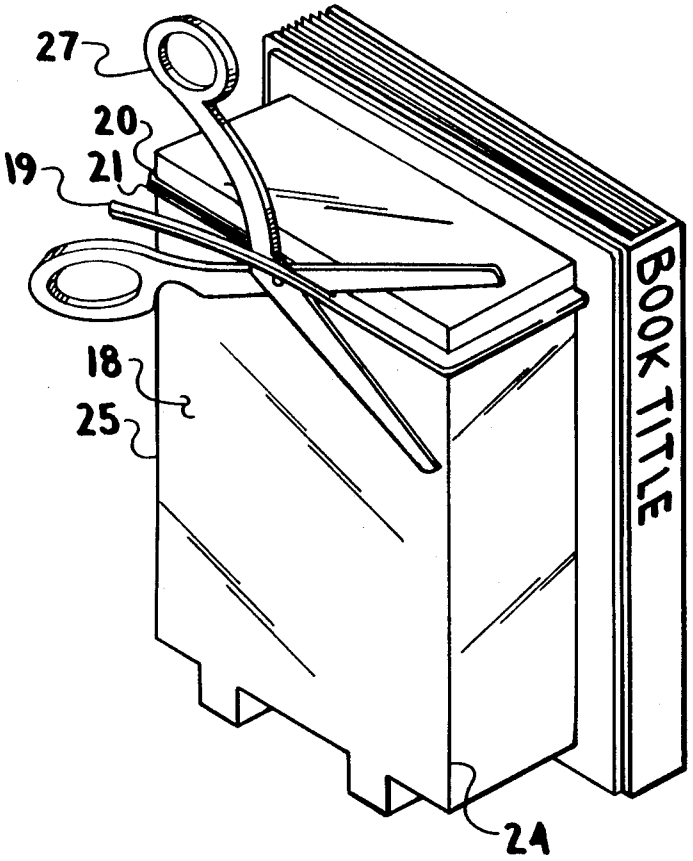
FIG. 7 is a perspective view of the book and container of FIG. 1, showing the opening process employing a pair of scissors.

FIG. 7 shows rib 19 being substantially cut away from legs 20 and 21 to separate top 15 from the back side 25, panel 18 and front side 24.

Figure 8:
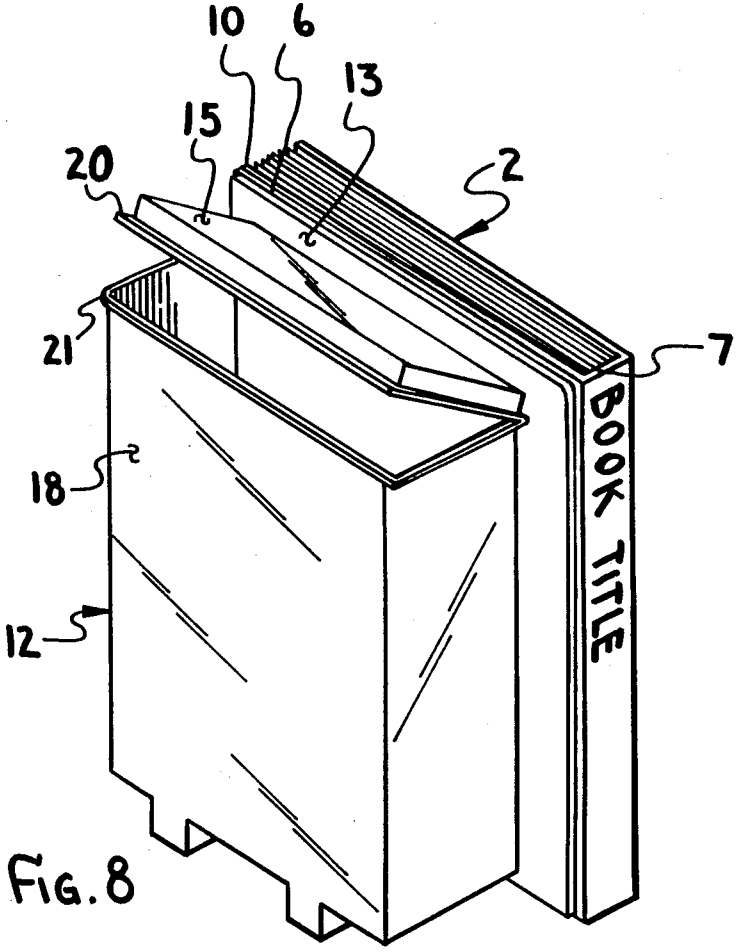
FIG. 8 is a perspective view of the book and container of FIG. 1 after being opened.

FIG. 8 shows the separation of leg 20 from leg 21 after removal of rib 19, whereby the top side 15 may be opened upwardly by flexure of the upper portion of flange 13 and the upper portion of the back cover 6 from spine 7 to the back edge 10, and permitting removal of a product by a customer, or storage of the product after initial removal of the product.

By the described embodiments the present invention provides a package for a product accompanying a book in which the book and package may be displayed normally and compatibly with other books on a book store shelf, preserving the sales potential of high traffic locations; wherein the book is not enclosed, permitting examination by a shopper, but in which the blister is very resistant to opening by a shopper in a store. The blister is easily opened by the purchaser at home and is reclosably for storage 7 of the product after the initial opening. The present invention describes an optimum single blister pack configuration, with the option for one skilled in the art to have more than one such blister on a single book, or make the blister out of other materials, such as paper or cardboard to achieve the same result in the same way.

We claim:

1. A book and container including:

a book having a top edge, a bottom edge, a front cover, a back cover, a spine defining a front edge, a plurality of pages bound together at the spine and openable at a back edge opposite the spine;

a formed thin-walled hollow container with one open side, having a generally planar perimeter flange, with the flange substantially attached to and closed by one of the book covers and including a generally planar panel parallel to the plane of the flange, a first side adjacent to the spine of the book, a second side adjacent to the back edge of the book, a top side at the top edge of the book and a bottom side at the bottom edge of the book, an integrally formed separation means comprising an upstanding rib in the cross-sectional shape of a narrow inverted U, wherein a first leg of the U is contiguous with the top side of the container, a second leg of the U is contiguous with the planar surface, the first side, and the second side, respectively, and the base of the inverted U is upstanding; whereby cutting the base of the U away from the legs of the U will separate the top side of the container from the remainder of the container and permit the container to be opened.

2. A book and mounted container according to claim 1 in which the separation means includes a perforated line joining the rib of the container to the planar panel, the first side, and the second side, respectively, whereby separating the perforated line will separate the rib and the top side of the container from the planar panel, the first side and the second side, respectively, and permit the container to be opened.

3. A book and mounted container according to claim 1 or 2 in which the top side of the container may be opened after separation by flexing the side flanges of the container and the cover of the book.

4. A book and mounted container according to claim 1 or 2 in which the container is formed of a transparent thermoplastic material.

5. A book and mounted container according to claim 1 or 2 in which at least a portion of the bottom of the container is substantially flush with the bottom edge of the book.

* * * * *